US005450094A

United States Patent [19]

Li et al.

[11] Patent Number: 5,450,094

[45] Date of Patent: Sep. 12, 1995

[54] OMNIBEARING DISPLAY METHOD AND APPARATUS

[76] Inventors: Zhe-an Li; Ke-fen Chen, both of 55/32 Yu Tian Xin Cun, Shanghai; Wei-qing Li, South 14/7/301 Yan Shan District, Jinan, Shandong, all of China

[21] Appl. No.: 193,909

[22] Filed: Feb. 9, 1994

Related U.S. Application Data

[63] Continuation of Ser. No. 922,699, Jul. 30, 1992, abandoned.

[30] Foreign Application Priority Data

Aug. 3, 1991 [CN] China ..... 91106503.2
Jul. 20, 1992 [CN] China ..... 92108510.9

[51] Int. Cl.[6] ..... G09G 3/20
[52] U.S. Cl. ..... 345/31; 40/431
[58] Field of Search ..... 40/431, 473, 430, 453; 345/7, 31, 32; 348/42, 44

[56] References Cited

U.S. PATENT DOCUMENTS

| | | | |
|---|---|---|---|
| 2,608,779 | 9/1952 | Joy | 40/431 |
| 3,097,261 | 7/1963 | Schipper | 340/755 |
| 3,135,063 | 6/1964 | Ricks | 40/473 |
| 4,639,081 | 1/1987 | O'Brien | 340/755 |

FOREIGN PATENT DOCUMENTS 0208283 1/1987 European Pat. Off. .

*Primary Examiner*—Curtis Kuntz
*Assistant Examiner*—Minsun Oh
*Attorney, Agent, or Firm*—Merchant, Gould, Smith, Edell, Welter & Schmidt

[57] ABSTRACT

An omnibearing display, having a display face, with the blanking element in front of the display face, is rotated with a high speed by a rotation actuating mechanism to cyclically and repeatedly appear to eyes of an observer around the display face within a duration of persistence of vision. This results in an effect that observers at any positions around the display face will see the same display face within the duration of persistence of vision, namely, the omnibearing display effect.

32 Claims, 5 Drawing Sheets

OMNIBEARING DISPLAY METHOD AND APPARATUS

This is a continuation of U.S. Application Ser. No. 07/922,699 filed Jul. 30, 1992, now abandoned.

The present invention relates to a display technique, particularly to a method for obtaining continuous omnibearing display effect by taking advantage of persistence of vision and to an apparatus for achieving the effect according to the method.

In the prior art, any pictures to be displayed (including plane picture, stereo picture, a specific plane of a solid object and dynamic picture which will be hereafter collectively referred to as display front or display face) can be observed only within certain limits. Even if the picture or the display front (display face) is very clear, it can be seen only within limits of a certain angle. Needless to say, to observe its lateral or back side in this case is impossible. Even an observer is in front of the display face, the effect of observation may be degradated due to a tilt of the viewing angle.

In order to overcome the deficiencies, in practical uses, several identical pictures are usually prepared and arranged uniformly towards several directions so that they can be observed in a wider scope. For instance, the information screen, clock or advertising board placed in a hall or on the top of a big building art often so arranged to achieve the effect of expanding the field of vision. But this simple combination of the several displaying pictures cannot make an observer situated at any positions enjoy the vision effect of observing just as in front of the picture.

In the prior art, certain attempts have been made to take advantage of the phenomenon of persistence of vision in which the static pictures gradually changing according to a certain pattern are passing continuously through human eyes to produce effects of television, film or animated carton, however, an observer can't still enjoy the effect of omnibearing display at any positions.

The object of the present invention is to provide a method of obtaining omnibearing display effect and an apparatus for realizing it, in which, by taking advantage of the persistence of vision, the picture to be displayed is made to repeatedly appear to the eyes of observers around it within the duration of the persistence of vision, thereby the visual effect of omnibearing display is obtained.

The technical aspect according to the present invention will be described in the following.

A method of omnibearing display comprises a display screen with a blanking means in front of the display face of the display screen is made rotatable about a vertical axis or is made simultaneously rotatable about a horizontal axis or is made simultaneously to pitch about a horizontal axis, the rotation rate $V_1$ about the vertical axis is greater than 12 cycles/sec, preferably 20–60 cycles/see, while the speed of rotation about the horizontal axis is $V_2 = V_1 \times 360°/\alpha$ or the number of times of the pitching oscillation is $$n = \frac{\beta \times \gamma}{\alpha} \times V_1 \times \text{times/cycle.}$$

In the above formulas, a is a horizontal circumferential angle that the display screen rotates over when any picture element divided by the blanking means begins to appear before, then disappears from the eyes of an observer in the course of rotation of the display screen about the vertical axis. $\beta$ is an angle of elevation about the horizontal axis, $\gamma$ is an angle of depression about the horizontal axis.

In the technical scheme of the present invention, the display face is made to rotate about a vertical axis or simultaneously to rotate about a horizontal axis or to pitch about a horizontal axis, thereby continuously, repeatedly sweeping a 360° cyclic or spherical region with the display front or face as the center. In front of the display screen, there is a blanking means which rotates synchronously with the display screen. The role of the blanking means is to limit the scope of observation so that the display screen can only be seen to the observer when it rotates to the position in front of the observer, and when the display screen has rotated over a small angle from this position, due to the action of the blanking means, the image of the display screen disappears from the eyes of the observer immediately, thereby avioding a superimposition of different oriented images during the rotation of the display screen. Due to the persistence of vision, the image of the display screen will continue to appear for a short period of time and when this image remains to be presented to the eyes of the observer, the display screen rotates again to the front of the observer so that it can be seen by the observer again and this goes round and round repeatedly. Through the coordination of the rotational movement and the blanking means, an observer at any positions within a 360° cyclic or spherical region will obtain the visual effect as if the display screen is always in front of himself (herself), namely the effect of omnibearing display.

The picture or the display face itself in its display state in fact is not continuously presented to the observer, therefore in order that the nervous optics of an observer can obtain enough luminous flux of the picture or the display face to ensure the visual reaction and to make it possible for an observer to see clearly the picture or the display face, the display face is preferably luminous. For this purpose, the display screen can be made luminous itself or it may be illuminated by a light source.

If the display screen is made luminous itself, the display screen will be heated, if the display is illuminated, both the display screen and the light source will be heated. So the display screen and the light source must be cooled, for example, by air cooling.

In the practical usage, due to the fact that it is more difficult for the display screen rotates simultaneously about a vertical and a horizontal axis, in general conditions, it is more simple to adopt the omnibearing display method in which the display screen only rotates about a vertical axis. When an observer is approximately on a level with the display face, the omnibearing display effect, i.e. the visual effect that the display face is always in front of the observer can be still obtained.

According to the aspect of the present invention, an apparatus is provided for realizing the method put forward by the invention. The apparatus comprises a base, a display screen, and a rotating mechanism mounted on the base. The display screen is connected with the base, and in front of the display screen, there is a blanking means fixedly attached to the display screen.

The above-mentioned rotating mechanism can be such that the display screen rotates simultaneously about a vertical and a horizontal axis, or while rotating about a vertical axis the display screen is making pitching oscillation about a horizontal axis or simply the display screen rotates about a vertical axis only, thereby providing omnibearing display apparatus with different forms and effects.

For the display screen rotating simultaneously about a vertical and a horizontal axis or for the display screen making pitching oscillation about a horizontal axis while rotating about a vertical axis, the blanking means can be a grid structure consisting of non-transparent, non-reflecting dark tone thin pieces which are perpendicular to the display face and intersecting to form a grid structure of vanous shapes such as triangle, rectangle, or polygon, or the blanking means can be a honeycomb structure consisting of non-transparent, non-reflecting dark tone thin wall slender pipes which are perpendicular to the display face and closely arranged.

For the display screen rotating only about a vertical axis, the blanking means com be a grid plate consist of non-transparent, non-reflecting thin pieces which are perpendicular to the display face and vertically mutually parallelly arranged or may be a light guiding plate which is formed through filling further the spaces between the thin pieces by material with the index of refraction being close to the atmosphere.

The role of the blanking means is the same as described above, therefore details are not given here.

Due to the fact that high wind resistance will occur to both the display screen rotating about a vertical axis and about a horizontal axis, a transparent wind-proof casing may be added in the rotating mechanism. The wind-proof casing covers the display screen etc. and has a symmetric surface configuration about the axis of rotation to reduce wind resistance.

Furthermore, for display screen which rotates simultaneously about a horizontal axis and a vertical axis, due to the fact that the display screen will be alternately in the upward and downward positions, in order to avoid the superimposition of the upright and inverted images of the display front to the eyes of the observer caused by the upward and downward positions of the display screen, a view obstructing plate is added to the rotating mechanism which plate is not rotating about the horizontal axis but is fixedly parallel with it so that when the display screen is at a downward position (inverted image), the display front or face is obstructed to the eyes of the observer.

Because it is desirable that the display face of the display screen is luminous, the display screen may be made luminous by itself or may be illuminated by a electric light source. In order to prevent the electric light source and the display screen from being heated (excessive temperature), a cooling means may be added, for example, an air cooling means, of course other cooling means can be used too to cool off the display screen and the electric light source.

The advantage of the present invention is a larger effective display scope. An observer at any positions within the spherical region or 360° cyclic region with the display screen as the center can enjoy a visual effect of observation just as in front of the display screen.

In the following, a detailed description of the preferred embodiments according to the present invention will be made in conjunction with the accompanying drawings so as to make the other objects, features and advantages to be more apparent; wherein.

Figure 1:
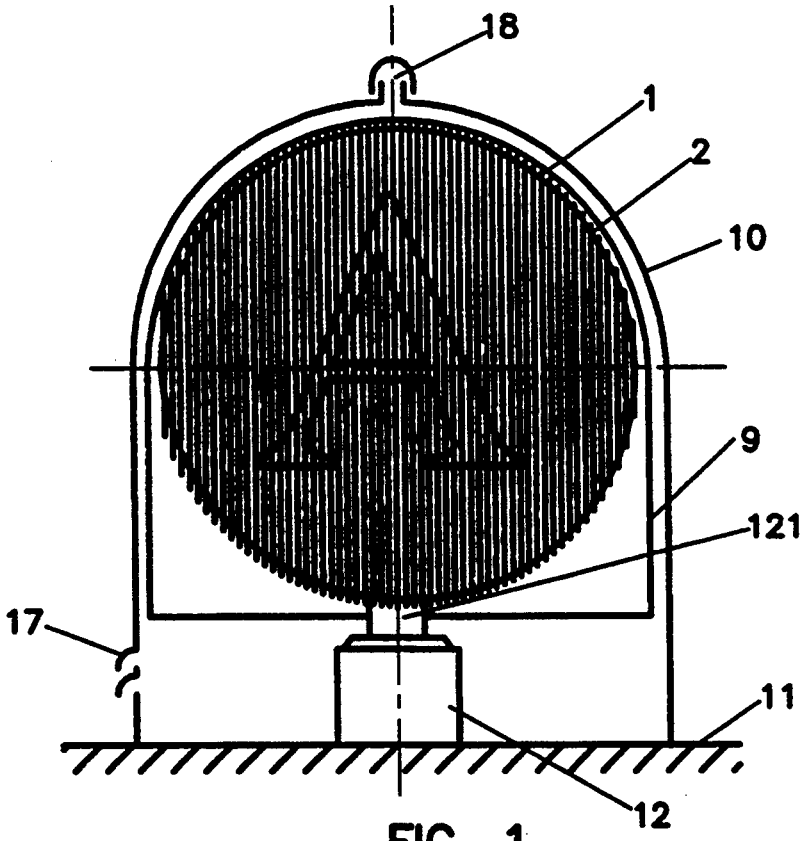
FIG. 1 is a schematic view of the structure of an omnibearing display apparatus according to the present invention.
Figure 2:
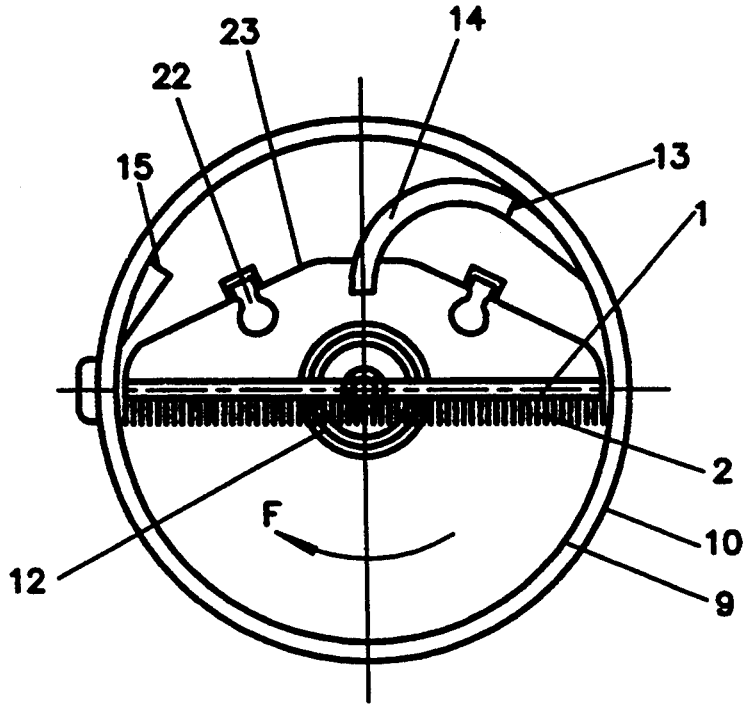
FIG. 2 is a schematic top view of the apparatus shown in FIG. 1.

Now please refer to FIG. 1 and FIG. 2. The omnibearing display apparatus according to the present invention comprises a base 11, a vertical rotation actuating means 12 mounted on the base 11 for actuating rotation about a vertical axis which stands for the rotating mechanism (hereafter referred to as vertical rotation actuating means for short), for example, a motor or an internal combustion engine, a display screen 1 connected to the motor 12 via a vertical shaft 121. In front of the display face or display front of the display screen 1 for example the display face A, there is a blanking means 2 fixedly disposed to the display screen, the blanking means 2 preferably is a grid plate made of non-transparent, non-reflecting dark tone thin pieces which are perpendicular to the display face or the display front A and arranged vertically as well as parallelly on the display, or, the blanking means will be a light guide plate made of transparent material filled between the space of the thin pieces of the grid plate, with such a material with the index of refraction similar to that of atmosphere, is fixedly attached to the grid, for example, attached by a bonding agent. After the blanking means has been attached in front of the display face A, the display face A can only be seen when it is rotated to the position just in front of the observer. When the display face A is rotated over a small angle from this position, the display face A will be obstructed by the thin pieces of the grid plate or of the light guiding plate from the view of the observer, thereby avoiding a superimposition of the images oriented in different directions to the eyes of the observer during the rotation of the display face or the display front A (this superimposition will lead to the obscurity of the whole picture)and ensuring the picture of be seen by the observer is the picture of the display face or display front A, and through the action of the persistence of vision, a visual effect that the display front A is continuously in front of the observer is produced to the eyes of the observer, although, in fact, the display face or display front is not continuously presented to him (her).

In order to ensure that within the duration of the persistence of vision, the display face or display front will appear repeatedly, the rotation rate $V_1$ of the vertical shaft 121 must be greater than 12 cycles/sec., preferably in the range of 20–60 cycles/sec. The reason why the index of refraction of the transparent material used in the light guiding plate must be near to the index of refraction of atmosphere lies in that all transparent materials, when illuminated, will produce flood rays of varying degrees, and these flood rays, as background light, will be superimposed into the images of the display face or the display front, thereby reducing the contrast of the images of the display face or display front A. The nearer is the index of refraction of the transparent material to that of the atmosphere, the weaker is the flood ray, and the smaller is the influence of the flood ray on the images of the display face or display front A.

Due to the fact that a large wind resistance will occur when the display screen 1 rotates with a high speed, a wind-proof casing 9 will be added which is fixedly attached to the vertical shaft 121 and the display screen 1 and which contains the display screen and the blanking means 2. The shape or appearance of the wind-proof casing is of a surface configuration symmetric about the rotation axis such as the shape of a sphere, a cylinder etc.

In addition, in order to make the display A more luminous, the display face or the display front A may be illuminated or may be made luminous itself, for example, the display screen may be made of transparent material or semi-transparent material, and an electric light source 22 may be placed in the wind proof casing 9 behind the display screen 1. With the view of reducing the heating of the electric light source (excessive temperature rise) and the heating of the display screen due to illumination, a wind (suction) inlet and wind (exhaust) outlet 13, 15 are disposed tangentially on the side wall of the wind-proof casing 9 behind the display screen respectively, at the same time, one or more wind guiding pipes 14 will be disposed in the wind-proof casing 9 behind the display screen such that one end of the wind guarding pipe is communicated with the wind (suction) inlet and the other end is directed toward (aligned with) the electric light source or is simultaneously aligned with the display screen 1. Thus, when the wind-proof casing 9 and the display screen 1 rotate, the wind (suction)inlet 13, the opening of which is facing windward; will atomatically draw in strong cold air, and the cold air, guided by the wind guiding pipe will blow onto the electric light source or and the display screen 1 to cool them. With the view of preventing the rays of the electric light 22 source from spreading out and from adversely influencing the effect serving the display face or display front A, the wind-proof casing 9 behind the display screen may be made of non-transparent material.

As a preferred option, the electric light source may be placed in the middle behind of the display screen 1, for example, in the middle of the back side of the display screen 1, and the other end of the wind guiding pipe 14 is directed toward it from behind the light source, so that the wind blown out of the wind guiding pipe can simultaneously cool the electric light source as well as the display screen 1 when passing through it. Furthermore, the cold wind, driven by the pressure of the sucked wind, will blow all around and pass through all the heated portions from the middle, and finally will reach the edge of the wind-proof casing 9 and then exhaust from the opening of the wind exhaust outlet 15 facing leeward. In order to make the cold wind distribute more evenly, the other end of the wind guiding pipe 14 may be made in flat shape.

As an option, the above-mentioned illumination structure may be changed as follows: An electric light source is placed around the display front A of the display screen behind the grid plate or the light guiding plate 2 arid a light shut-off plate 23 is fixedly disposed between the electric light source and the grid plate or the light guiding plate 2. In this way, both illuminating the display face A and preventing the light from passing onward directly from the display front A can be realized. The air cooling structure is similar to the above-mentioned structure, i.e. the other end of the wind guiding pipe is directed toward the electric light source and the display screen 1, at the same time, the wind-proof casing 9 behind the display screen 1 is made non-transparent.

If the display screen 1 is made luminous itself, neon lamps may be placed in the display screen 1 or the whole display screen 1 may consist of neon lamps and a fixed frame may be arranged in periphery to form, for example, a advertising board. The air cooling structure is also similar to the above-mentioned structure, i.e. it is simply to direct the other end of the wind guiding pipe towards the display screen 1, at the same time, the wind-proof casing behind the display screen is made non-transparent to prevent the light rays from escaping.

In the view of giving protection to the whole omnibearing display apparatus, a transparent casing 10 may be used to cover it completely. The transparent casing 10 may be fixedly attached to the base 11. For the circulation of air, a wind inlet 17 may be defined on the lower side wall of the casing 10 and a wind outlet 18 may be defined on the upper side wall or on the top wall of the casing 10 correspondingly so that the hot wind exhausted from the wind-proof casing 9 can escape timely from the wind outlet 18 on the casing while the cool air is drawn in through the wind inlet 17 on the lower part of the casing. The exhaust of the hot air from the wind outlet 18 of the casing 10 relies on the natural asnd-proof casing 9 can escape timely from the wind outlet 18 on the casing while the cool air is drawn in through the wind inlet 17 on the lower part of the casing. The exhaust of the hot air from the wind outlet 18 of the casing 10 relies on the natural ascension of the hot air, if the hot air generated in the wind-proof casing 9 is large in volume, such that the hot air cannot exhaust timely through natural ventilation, a mechanical air discharge means may be added.

The arrow F shown in FIG. 2 indicates the direction of rotation.

In the above embodiment, if an observer is at any position in which he is on a level with the display play apparatus and in which he is within a 360° cyclic region with the display apparatus as center, he will see the display front or display face A just as in front of him (her). If the observer is at a position higher or lower than the display apparatus, it will be better that the display screen is tilted upward or downward to help the observation.

Figure 3:
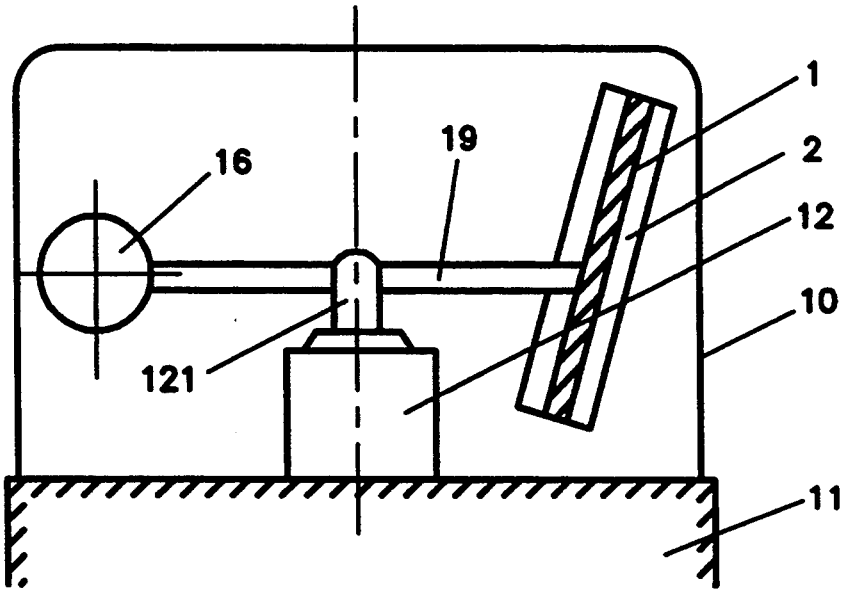
FIG. 3 is a schematic view of the structure of another omnibearing display apparatus according to the present invention.
Figure 4:
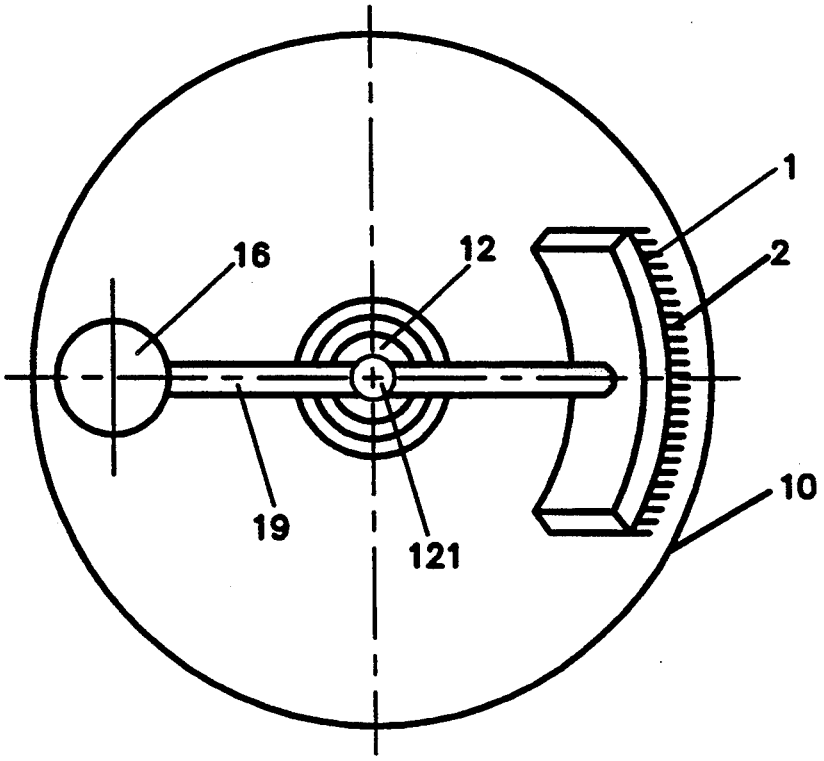
FIG. 4 is a schematic top view of the apparatus shown in FIG. 3.

FIG. 3 and FIG. 4 show an omnibearing display apparatus with screen 1 and the blanking means inclined downward, in which the display screen 1 is fixedly connected with one end of a horizontal fixing rod 19, which, in turn, is connected with a motor 12 via a vertical shaft 121, the other end of the fixing rod 19 is connected with a counterweight 16 to ensure a balanced rotation.

Figure 5:
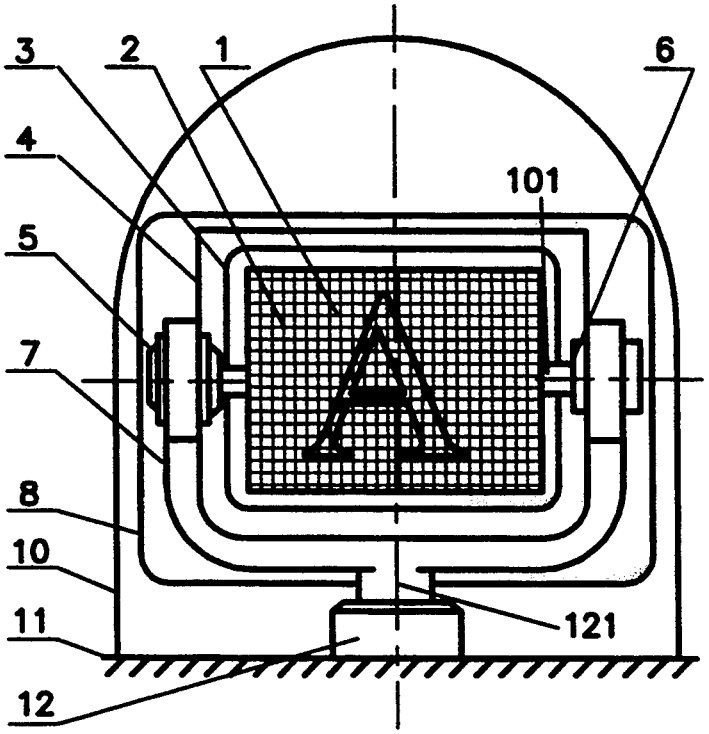
FIG. 5 is a schematic view of the structure of still another omnibearing display apparatus according to the present invention.
Figure 6:
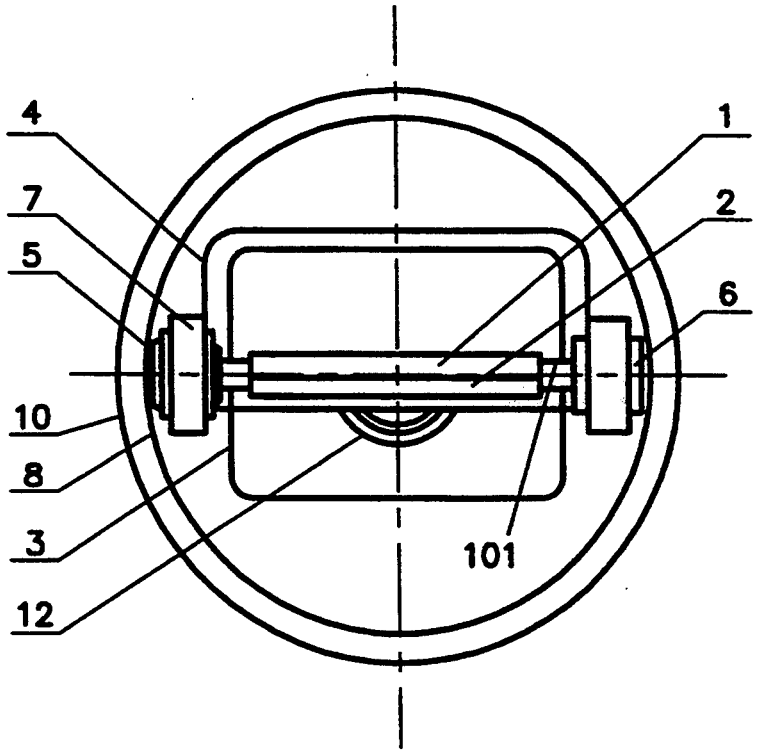
FIG. 6 is a schematic top view of the apparatus shown in FIG. 5.
Figure 7:
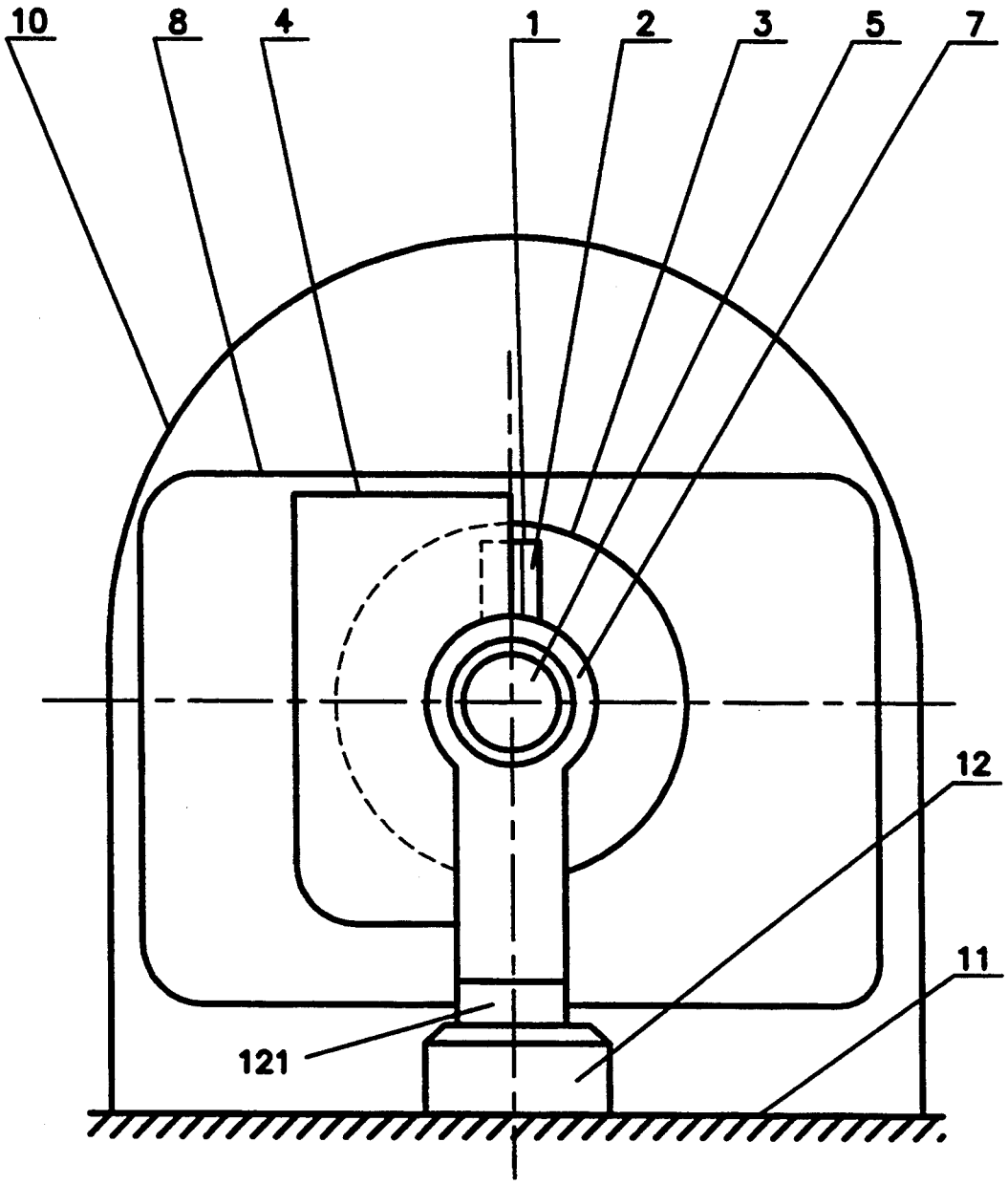
FIG. 7 is a schematic left (side) view of the apparatus shown in FIG. 5

FIG. 5, FIG. 6 and FIG. 7 show another embodiment of omnibearing display apparatus according to the present invention. It comprises a base 11, a display screen 1, a blanking means fixedly placed in front of the display play front or display face A of the display screen 1, and a rotating mechanism mounted on the base 11. The rotating mechanism consists of a vertical rotation actuating means 12 (i.e. rotation actuating means for actuating rotation about a vertical axis), for example, a motor or an internal combustion engine, an U-shaped support 7, the bottom of which is connected to the motor of the actuating means 12 via a vertical shaft 121. On one end of the U-shaped support 7 is mounted a horizontal rotation actuating mean 5 (i.e. a rotaling actuating means for actuating rotation about a horizontal axis), for example, a motor. The display screen 1 is fixedly connected with a horizontal shaft 101, with one end of which (shaft 101) connected with the horizontal motor 5 (for rotation about an horizontal axis) and the other end rotatably mounted on the other end of the U-shaped support 7 throng a ball bearing 6. Thereby the display screen 1, under the actuation of the vertical motor 12 and the horizontal motor 5, can simultaneously rotates about the axis of the vertical shaft 121 and the axis of the horizontal shaft 101, The role of the blanking means 2 is to ensure that the display face or front A can only be seen when it rotates to the position in front of the observer. When the display face (front) A has rotated over a small angle from this position about the axis of the vertical shaft or about the axis of the horizontal shaft, the blanking means 2 will shut out the display front A, thereby avoiding the superimposition of the images with different orientations during the rotation of the display front A. Therefore the blanking means 2 is preferably a grid structure of various shapes such as triangle, rectangle or polygon etc. consisting of non-transparent, non-reflecting dark tone thin pieces which are perpendicular to the display front A and intersecting, or the blanking means 2 may be of a honeycomb structure consisting of non-transparent, non-reflecting dark tone thin wall slender pipes which are perpendicular to the display face or front A and arranged density. Furthermore, in order to avoid the superimposition of the upright and inverted images of the display front to the eyes of the observer caused by the upward and downward positions of the display screen 1, a view obstructing plate 4 must be added to the rotating mechanism, which plate does not rotate about the axis of the horizontal shaft 101 but parallel to it. When the display screen 1 is in the downward position, the display front A is shut out by the view obstructing plate 4, thereby the display front A is not seen by the observer, the view obstructing plate 4 may be fixedly mounted on the U-shaped support 7 and may be in the shape of a dustpan (FIG. 7).

The display apparatus of the this embodiment can make an observer at any position within the spherical region with the display apparatus as a center always see the display front A in front of him. The display scope of this embodiment is much larger than that of the previous embodiment, but there is a small blind region in the upper-middle of the apparatus.

In order to ensure the display front or display face A to appear repeatedly within the duration of the persistence of vision, the rotation rate $V_1$ of the vertical shaft 121 must be larger than 12 cycles/sec., preferably in the range of 20–60 cycles/sec. The rotation rate $V_2$ of the horizontal shaft 101 must be $V_2=V_1\times 360°/\alpha$, where $\alpha$ is the horizontal circumferencial angle that the display front A rotates over when any element of the display front A divided by the blanking means begins to appear be fore and then disappears from the eyes of the observer in the process in which the display front A rotates about the axis of the vertical shaft 121. The magnitude of $\alpha$ depends on the structure and the size of the blanking means.

In order to reduce the wind resistance confronted by the display screen 1 and the U-shaped support 7 during rotation (in rotational state), the rotation mechanism may be provided with a horizontal transparent wind-proof casing 3 which is fixedly attached to the horizontal shaft 101 and the display screen 1 and contains the display screen 1 and the blanking means with a surface configuration symmetric about the rotation axis such as in the shape of a sphere, a cylinder etc, and a vertical transparent wind-proof casing 8 which is fixedly attached to the vertical shaft 121 and the U-shaped support 7 and which contains the U-shaped support 7, the display screen 1, the blanking means 2, the horizontal motor 5, the view obstructing plate 4 and the horizontal wind-proof casing 3, with the surface configuration symmetric about the rotational axis such as in the shape of a sphere, a cylinder etc.

In addition, similar to the above-mentioned embodiment, in order to display front (display face) A more luminous, an electric light source may be added within the horizontal wind-proof casing 3 to illuminate the display screen 1, and the electric light source and the display screen 1 can be cooled. For example, the display screen 1 may be made transparent or semi-transparent, and an electric light source is placed in the horizontal wind-proof casing 3 behind the display screen 1, and a wind inlet and a wind exhaust outlet are defined tangentially on the side wall of the horizontal wind-proof casing (the horizontal and vertical wind-proof casing 3 here mean the wind-proof casings used in horizontal rotation and vertical rotation respectively) behind the display screen 1, as well as one or more wind guiding pipe(s) is (are) disposed in the horizontal wind-proof casing 3 behind the display screen 1. One end of the wind guiding pipe(s) is communicated with the wind inlet, the other end is directed toward (aligned with) the electric light source and the display screen 1. At the same time, the horizontal wind-proof casing 3 behind the display screen is made non-transparent. As a preferred option, the electric light source may be placed in the middle behind the display screen 1, for example, in the middle of the back side of the display screen 1 and the other end of the wind guiding pipe(s) is made aligned with the electric light source from behind it to cool the electric light source and the display screen 1 simultaneously. The other end of the wind guiding pipe(s) may be made flat to make the cold air blown out more evenly distributed. For a better air circulation, a wind inlet and a wind exhaust outlet must be disposed tangentially on the side wall of the vertical wind-proof casing 8. The structure here is similar to that of the above-mentioned embodiment for the clarity of the FIGS. 5, 6 and 7. It is not shown in these drawings.

Similar to the above-mentioned embodiment, a transparent casing (housing) 10 may be covered on the apparatus, and may be fixedly attached to the base 11. And for air circulation, a wind inlet should be defined in the lower side wall of the casing 10 and a wind outlet should be disposed on its upper side wall or on the top wall.

It should be mentioned that with the embodiments shown in FIG. 5, FIG. 6 and FIG. 7, an observer at any positions within the spherical region with the display apparatus as the center can see a display front (display face) A just as in front of him (her).

Figure 8:
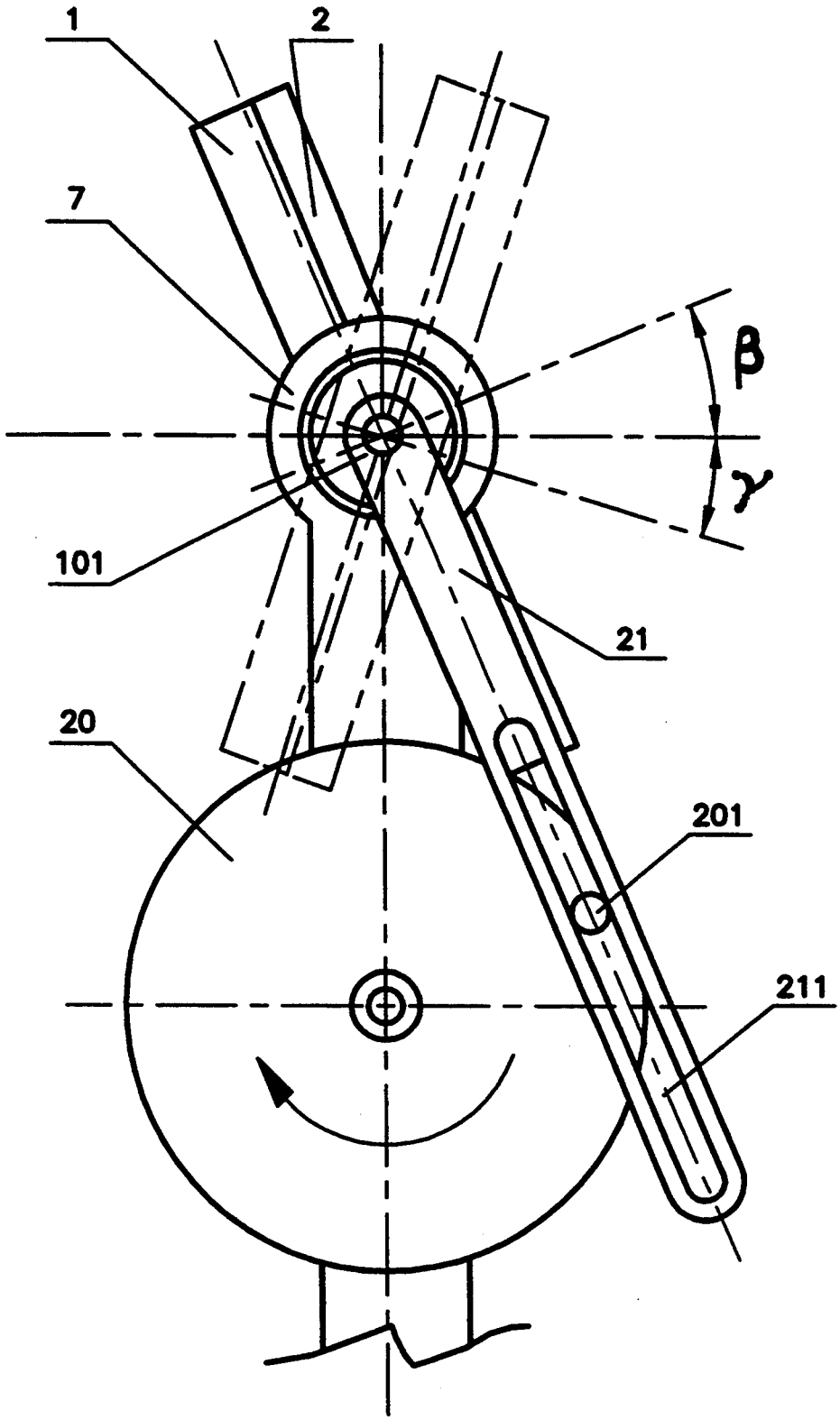
FIG. 8 is a partial schematic view of the structure of a further omnibearing display apparatus according to the present invention.

When the pitching angle of the display front A need not be very large, the rotation of the display front A about the horizontal axis can be replaced by the pitching oscillation about the horizontal axis as shown in FIG. 8. If the angle of elevation about the horizontal axis is $\beta$; and the angle of depression is $\gamma$, the number of times of the oscillation per second is n.

$$n = \frac{\beta + \gamma}{\alpha} \times V_1 \times \text{times/cycle}$$

Therefore the rotating mechanism of the above-mentioned embodiment can be modified such that the vertical rotation actuating means 12 and the U-shaped support 7 remain unchanged and the horizontal rotation actuating means 5 is mounted on the lower part of the U-shaped support (not-shown) and an actuating wheel 20 connected with the horizontal rotation actuating means 5 is added. For example, the wheel 20 can be rotatably mounted on the lower outer side or inner side of the U-shaped support 7, and a dowel pin 201 will be fixedly placed some distance apart from the center on the end face of the wheel 20. Furthermore the display screen 1 is fixedly attached to a horizontal shaft 101, the two ends of which (the shaft 101) are rotatably mounted on the two end of the U-shaped support, while one end of the horizontal shaft 101 is equipped with a rocker 21 extending down ward. On the lower part of the rocker 21 is defined an elongated opening 211 extending along its axis, which is movably mounted (preferably movably fitted) over the dowel pin 201, In this way, when the horizontal rotation actuating mean 5 rotates, the display screen 1 is able to make pitching oscillation through the actuating wheel 20, the dowel pin 201 and the rocker 21. At the same time, the display play screen 1 rotates about the vertical axis, so that an observer at any positions within the spherical region with the display screen as the center (but the crown of the spherical region not included) can always see the display front A just as in front of him (her).

Similar to the above-mentioned embodiment, in order to reduce the wind resistance, a vertical rotary wind-proof casing 8 may be added, but due to the fact that the display screen 1 does not rotate about the horizontal axis, therefore when the angle $(\beta+\gamma)$ of the pitching oscillation is not very large, a horizontal rotary wind-proof casing is not needed.

In addition, in order to make the display front (display face) A more luminous, an electric light source may be placed within the vertical rotary wind-proof casing 8 behind the display screen 1 for illuminating the display screen (the display screen is transparent or semi-transparent). For example the electric light source may be placed in the middle behind the display screen 1. At the same time, a wind inlet and a wind exhaustion outlet will be disposed tangentially on the side wall of the vertical wind-proof casing 8 behind the display screen 1 and one or more wind guiding pipe (s) will be disposed in the vertical rotary wind-proof casing 8 behind the display screen 1 to cool the electric light source and the display screen 1. Furthermore a transparent casing housing 10 may be added and an wind inlet as well as a wind exhaustion outlet should be defined on the casing 10.

The above embodiments are only described by way of examples to illustrate the present invention. It can be understood that the technicians in the field of the present invention can put forward other embodiments according to the concept disclosed here, therefore all modifications and changes made without departing the scprit and the scope of the present invention will be covered by the claims.

We claim:

1. An omnibearing display apparatus, comprising a base, a display screen, wherein a rotating mechanism mounted on the base, said display screen being connected with said rotating mechanism and a blanking means placed in front of a display face of the display screen and fixedly attached to said display screen, said rotating mechanism comprising a vertical rotation actuating means mounted on the base, a U-shaped support, a bottom of which being connected to the vertical rotation means via a vertical shaft, a horizontal rotation actuating means mounted on a lower part of the U-shaped support, and an actuating wheel connected to the horizontal rotation actuating means, a dowel pin fixed on an end face of the actuating wheel by a distance apart from a center, said display screen being fixedly connected with a horizontal shaft, two ends of which being rotatably mounted respectively on two ends of the U-shaped support, one end of the horizontal shaft being fixed with a rocker extending downwards, and elongated opening extending along an axis being defined on a lower part of the rocker and movably fitted on said dowel pin, said blanking means being a grid structure having non-transparent, non-reflecting dark tone thin pieces perpendicular to the display face and intersecting and being a honeycomb like structure having non-transparent, non-reflecting dark tone thin wall slender pipes being perpendicular to the display face and densely arranged.

2. The display apparatus as claimed in claim 1, characterized in that said rotating mechanism also having a transparent wind-proof casing fixedly mounted on the U-shaped support and covering the U-shaped support, the display screen, the blanking means, the horizontal rotation actuating means, the actuating wheel, the rocker and the dowel pin, the shape or appearance of the vertical wind-proof casing being of a symmetric surface configuration about the rotation axis.

3. The display apparatus as claimed in claim 2, characterized in that said display screen being transparent or semi-transparent, and an electric light source for illuminating the display screen being disposed in the vertical wind-proof casing behind the display screen, a wind suction inlet and a wind exhaust outlet being defined tangentially respectively on the side wall of the vertical wind-proof casing, a wind guiding pipe being disposed in the vertical wind-proof casing behind the display screen with one end of which communicated with the wind suction inlet and the other end aligned with the electric light source or and the display screen, the vertical wind-proof casing behind the display screen being made non-transparent.

4. The display apparatus as claimed in claim 3, characterized in that said electric light source being placed in the middle behind the display screen, the other end of said wind guiding pipe being flat in form and aligned with the electric light source.

5. The display apparatus as claimed in claim 4, characterized in that it having also a transparent casing covering the whole apparatus and fixedly mounted on the base, a wind inlet being defined on the lower side wall of the casing, a wind outlet being defined on the upper side wall or on the top wall.

6. A method of omnibearing display, comprising the steps of:

providing a blanking means in front of a display face of a one-sided display screen, said blanking means comprising a grid of non-transparent, non-reflecting dark tone thin pieces arranged perpendicular to said display screen and parallel to each other illuminating said display screen by an illuminating source;

rotating said display screen about a vertical axis at a speed of $V_1$; and showing a picture to observers at any position around said display screen by rotating said display screen at said speed which is high enough to repeatedly show the picture within a duration of persistence of vision of said observers so that said observers at any position observe the same picture to be a continuous display.

7. The method as claimed in claim 6, wherein said speed of $V_1$ is greater than 12 cycles/sec.

8. The method as claimed in claim 7, wherein said display screen rotates simultaneously about a horizontal axis at a speed of $V_2$, $V_2=V_1\times 360°/\alpha$, where $\alpha$ is a horizontal circumferential angle over which the display face rotates when any picture element of the display face divided by the blanking means begins to appear before and then disappears from the eyes of an observer when the display face rotates about the vertical axis.

9. The method as claimed in claim 8 wherein said display screen is illuminated and the illumination source and an illuminated display screen are both cooled.

10. The method as claimed in claim 7 wherein the display screen simultaneously makes oscillating movement about the horizontal axis with a number of time of oscillation being n, $n=(\beta+\Gamma)/\alpha\times V_1\times$times/cycle, wherein: $\beta$ is an angle of an elevation of the oscillating movement of the display screen, $\Gamma$ is an angle of a depression of the oscillating movement of the display screen, $\alpha$ is the horizontal circumferential angle over which the display face rotates when any picture element of the display face divided by the blanking means begins to appear before and then disappears from the eyes of the observer in the process during which the display face rotates about the vertical axis.

11. The method as claimed in claim 10, wherein said display screen is illuminated and the illuminating source and an illuminated display screen are both cooled.

12. The method as claimed in claim 7, wherein the illuminating source and an illuminated display screen are both cooled.

13. An omnibearing display apparatus, comprising:

a base;

a one-sided display screen;

an electric light source for illuminating said display screen;

a rotating mechanism mounted on the base;

blanking means, placed in front of a display face of the display screen, for repeatedly showing a picture to be displayed to observers at any position around said display screen within a duration of persistence of vision, so that said observers at any position will observe the same picture to be a continuous display; and wherein said display screen is connected with said rotating mechanism, said blanking means is a grid plate having non-transparent, non-reflecting dark tone thin pieces which are perpendicular to said display face and which are arranged vertically and parallel to each other on the display screen.

14. The display apparatus as claimed in claim 13, wherein said rotating mechanism comprises a rotation actuating means for actuating rotation of the display screen about a vertical axis which hereafter is referred to as vertical rotation actuating means for short, said vertical rotation actuating means being connected with the display screen, said rotating mechanism further having a transparent wind-proof casing with a surface configuration symmetric about an axis of rotation which is fixedly attached to the display screen and covers the display screen and the blanking means, said blanking means being a light guiding plate having said grid plate in spaces between the thin pieces being further filled with a transparent material with an index of refraction close to that of atmosphere, said material being fixedly attached to said grid plate.

15. The display apparatus as claimed in claim 14, wherein said rotating mechanism comprises a vertical rotation actuating means mounted on a base, a U-shaped support, a bottom of which is connected with said vertical rotation actuating means via a vertical shaft, a rotation actuating means for actuating rotation about a horizontal axis, hereafter referred to as horizontal rotation actuating means for short being mounted on one end of the U-shaped support, the display screen being connected with a horizontal shaft, one end of which being connected with the horizontal rotation actuating means and the other end of which being mounted rotatable on the other end of the U-shaped support, a view obstructing plate parallel with an axis of said horizontal shaft being fixedly mounted on the U-shaped support, said blanking means being a grid structure having non-transparent, non-reflecting dark tone thin pieces being perpendicular to the display face and intersecting and being a honeycomb-like structure having non-transparent, non-reflecting dark tone thin wall slender pipes being perpendicular to the display face and densely arranged.

16. The display apparatus as claimed in claim 15, wherein said rotating mechanism further comprises a transparent horizontal wind-proof casing with a surface configuration symmetrical about an axis of rotation fixedly connected with the display screen and covering the display screen and the blanking means, and a vertical wind-proof casing with a surface configuration symmetric about an axis of rotation fixed on the U-shaped support and covering the U-shaped support, the display screen, the blanking means, the horizontal rotation actuating means, the view obstructing plate and the horizontal wind-proof casing.

17. The display apparatus as claimed in claim 16, wherein said display screen is at least semi-transparent and the electric light source for illuminating the display screen being disposed in the horizontal wind-proof casing behind the display screen, and a wind suction inlet and a wind exhaust outlet being disposed tangentially on a side wall of the horizontal wind-proof casing behind the display screen respectively, a wind guiding pipe being disposed in the wind-proof casing behind the display screen with one end of the wind guiding pipe communicated with the wind suction inlet and the other end aligned with the electric light source and the display screen, the horizontal wind-proof casing behind the display screen being non-transparent, a wind inlet and a wind outlet being disposed tangentially respectively on a side wall of said vertical wind-proof casing.

18. The display apparatus as claimed in claim 17, wherein said electric light source is in a central position behind the display screen, the other end of said wind guiding pipe being of a flat shaped and being aligned with the electric light source.

19. The display apparatus as claimed in claim 18, further comprising a transparent casing covering the whole apparatus and being fixedly mounted on the base, said wind inlet being defined on a lower side wall of the transparent covering casing, a wind exhaust outlet being defined on an upper side wall.

20. The display apparatus as claimed in claim 14, wherein said display screen, together with the light guiding plate, is inclined upward and downward.

21. The display apparatus as claimed in claim 20, wherein said display screen is made of at least a semi-transparent material, and said electric light source being disposed within the wind-proof casing behind the display screen and, a wind suction inlet and a wind exhaust outlet being disposed tangentially respectively on a side wall of the wind-proof casing behind the display screen, a wind guiding pipe being also disposed within the wind-proof casing behind the display screen, one end of the wind guiding pipe being communicated with the wind suction inlet, the other end of the wind guiding pipe being aligned with the electric light source and the display screen, the wind-proof casing behind the display screen being made of a non-transparent material.

22. The display apparatus according to claim 21, wherein said electric light source is placed in a middle behind the display screen, the other end of said wind guiding pipe being flat in shape and being aligned with the electric light source from a back of the electric light source.

23. The display apparatus as claimed in claim 21, further comprising a transparent casing covering the whole apparatus and fixedly mounted on the base, a wind inlet being disposed on a lower side wall of the casing and a wind outlet being disposed on an upper side wall.

24. The display apparatus as claimed in claim 20, wherein the electric light source is disposed around the display face of the display screen and behind said grid plate and the light guiding plate, and a light shutting off plate being fixedly placed between said electric light source and the light guiding plate, and a wind suction inlet and a wind exhaust outlet being disposed tangentially respectively on the side wall of the wind-proof casing behind the display screen, a wind guiding pipe being disposed in the wind-proof casing behind the display screen with one end of the wind guiding pipe communicated with said wind suction inlet and with the other end of the wind guiding pipe aligned with the electric light source, said wind-proof casing behind the display screen being made of a non-transparent material.

25. The display apparatus as claimed in claim 24, further comprising a transparent casing covering the whole apparatus and fixedly mounted on the base, a wind inlet being disposed on a lower side wall of the casing and a wind outlet being disposed on an upper side wall.

26. The display apparatus as claimed in claim 20, wherein said display screen includes neon lamps, a wind suction inlet and a wind exhaust outlet being disposed tangentially respectively on a side wall of the wind-proof casing, a wind guiding pipe being disposed in the wind-proof casing behind the display screen with one end of which communicated with said wind suction inlet and with the other end aligned with the display screen.

27. The display apparatus as claimed in claim 26, further comprising a transparent casing covering the whole apparatus and fixedly mounted on the base, a wind inlet being disposed on a lower side wall of the casing and a wind outlet being disposed on an upper side wall.

28. An omnibearing display apparatus, comprising:

a base;

a one-sided display screen;

an electric light source for illuminating said display screen;

a rotating mechanism mounted on the base; and blanking means, placed in front of a display face of the display screen, for repeatedly showing a picture to be displayed to observers at any position around said display screen within a duration of persistence of vision, so that said observers at any position will see the same picture within the duration of persistence of vision; wherein said display screen is connected with said rotating mechanism, said blanking means is a grid plate having non-transparent, non-reflecting dark tone thin pieces which are perpendicular to said display face and which are arranged vertically and parallel to each other on the display screen; wherein said rotating mechanism comprises a vertical rotation actuating means mounted on the base, a U-shaped support, a bottom of which being connected to the vertical rotation means via a vertical shaft, a horizontal rotation actuating means mounted on a lower part of the U-shaped support, and an actuating wheel connected to the horizontal rotation actuating means, a dowel pin fixed on an end face of the actuating wheel by a distance apart from a center, said display screen being fixedly connected with a horizontal shaft, two ends of which being rotatably mounted respectively on two ends of the U-shaped support, one end of the horizontal shaft being fixed with a rocker extending downward, an elongated opening extending along an axis being defined on a lower part of the rocker and movably fitted on said dowel pin, said blanking means being a grid structure having non-transparent, non-reflecting dark tone thin pieces perpendicular to the display face and intersecting and being a honeycomb like structure having non-transparent, non-reflecting dark tone thin wall slender pieces being perpendicular to the display face and densely arranged.

29. The display apparatus as claimed in claim 28, wherein said rotating mechanism further comprises a transparent wind-proof casing fixedly mounted on the U-shaped support and covering the U-shaped support, the display screen, the blanking means, the horizontal rotation actuating means, the actuating wheel, the rocker and the dowel pin, the shape and appearance of the vertical wind-proof casing being of a symmetric surface configuration about the rotation axis.

30. The display apparatus as claimed in claim 29, wherein said display screen is at least semi-transparent, and the electric light source for illuminating the display screen being disposed in the vertical wind-proof casing behind the display screen, a wind suction inlet and a wind exhaust outlet being defined tangentially respectively on a side wall of the vertical wind-proof casing, a wind guiding pipe being disposed in the vertical wind-proof casing behind the display screen with one end of which communicated with the wind suction inlet and the other end aligned with the electric light source and the display screen, the vertical wind-proof casing behind the display screen being made of a non-transparent material.

31. The display apparatus as claimed in claim 30, wherein said electric light source is placed in a central position behind the display screen, the other end of said wind guiding pipe being flat in form and is aligned with the electric light source.

32. The display apparatus as claimed in claim 31, further comprising a transparent casing covering the whole apparatus and fixedly mounted on the base, a wind inlet being defined on a lower side wall of the casing, a wind outlet being defined on an upper side wall.

* * * * *